US007806356B2

(12) United States Patent
Poloni et al.

(10) Patent No.: US 7,806,356 B2
(45) Date of Patent: Oct. 5, 2010

(54) LAYING HEAD WITH MULTI-GROOVE ROTATING MEMBER

(75) Inventors: Alfredo Poloni, Fogliano Redipuglia (IT); Andrea De Luca, Remanzacco (IT)

(73) Assignee: Danieli & C. Officine Meccanicite S.p.A. (IT)

( * ) Notice: Subject to any disclaimer, the term of this patent is extended or adjusted under 35 U.S.C. 154(b) by 134 days.

(21) Appl. No.: 11/920,991

(22) PCT Filed: May 24, 2006

(86) PCT No.: PCT/EP2006/062564

§ 371 (c)(1),
(2), (4) Date: Nov. 21, 2007

(87) PCT Pub. No.: WO2006/125793

PCT Pub. Date: Nov. 30, 2006

(65) Prior Publication Data

US 2009/0121064 A1 May 14, 2009

(30) Foreign Application Priority Data

May 25, 2005 (IT) ..... MI2005A0952

(51) Int. Cl.
*B21C 47/14* (2006.01)

(52) U.S. Cl. ..... 242/361.2; 242/362

(58) Field of Classification Search ..... 242/360, 242/361, 361.1, 361.2, 361.3, 361.4, 361.5, 242/363

See application file for complete search history.

(56) References Cited

U.S. PATENT DOCUMENTS

| | | | | |
|---|---|---|---|---|
| 353,047 | A * | 11/1886 | Young | 242/361.5 |
| 5,934,594 | A * | 8/1999 | David | 242/361 |
| 6,073,916 | A * | 6/2000 | Plummer | 254/134.3 R |
| 6,098,909 | A | 8/2000 | Meyer et al. | |
| 6,345,780 | B1 * | 2/2002 | Poloni et al. | 242/361.3 |

FOREIGN PATENT DOCUMENTS

| | | |
|---|---|---|
| DE | 73100 | 1/1894 |
| JP | 5092869 | 4/1993 |

OTHER PUBLICATIONS

Ashlow Limited; "Coil Laying Head"; Research Disclosure; Mason Publications; vol. 255; No. 21; Jul. 1985.

* cited by examiner

*Primary Examiner*—William E Dondero
(74) *Attorney, Agent, or Firm*—Stetina Brunda Garred & Brucker

(57) ABSTRACT

A laying head, for forming coils starting from continuous rolled products such as round bars or wire rods (10) comprising a rotating member (3) with an axis (X), rotationally fixed to the supporting structure (30) by means of bearings (4, 5). The end of the rotating member (3) is a bell-shaped element (6) on the surface of which are a series of grooves (18) that guide the rolled product (10), said grooves having the form of a spiral and being open towards the outside. The laying head (1) comprises a fixed containing and protecting bell element (15) enclosing a portion of the rotating bell element (6) and having a shape that is complementary thereto.

7 Claims, 3 Drawing Sheets

LAYING HEAD WITH MULTI-GROOVE ROTATING MEMBER

FIELD OF THE INVENTION

The present invention relates to a laying head for continuous and substantially straight semi-finished products exiting from a rolling mill or from another analogous source, such as wire rods, round bars, or other products.

PRIOR ART

A solution that is commonly used to produce coils from metal wires with different diameters consists of using a laying head comprising a rotating member inside which a rolled product delivery and coil-forming tube is fixed. The rotating member is cantilevered to a stator body by means of two rolling bearings, or supports, and can thus rotate about its axis. The stator body is in turn rigidly anchored to a base plate. The rotating member generally rotates about its axis at high angular speeds, even in excess of 2000 rpm. The rotating member is set in rotation by an external motor connected by means of a bevel gear pair mechanism. Laying heads in which the motor is incorporated inside the rotating member and the motor stator is mounted coaxially are also known in the prior art.

During rotation of the laying head, the rolled product is curved by the tube so as to form a succession of coils having a given diameter, which are deposited by falling onto a roller conveyor belt so as to be cooled and delivered for collection and stacking.

As the metal wire passes through the coil-forming tube the latter is subject to high mechanical and thermal stresses, shocks and tangential thrusts that lead to severe wear on the inside of the tube, reducing its service life.

Having to frequently replace said tube causes particularly long down-times, reduced machine efficiency and high procurement and operating costs. Furthermore, the high centrifugal stresses to which the coil-forming tube is exposed deform the tube, altering its original geometric conformation and thus making the machine unbalanced. This fact precludes the possibility of further increasing the speed of rotation of the laying head, as required by modern rolling mills that are now capable of operating at rolling speeds that were previously unattainable.

To overcome these drawbacks solutions have been proposed to extend the service life of the tube by using wear-resistant and interchangeable tubular inserts, and to eliminate the tube altogether. For example, with reference to the latter case, document EP-A-779115 describes a laying head in which the coil-forming tube is replaced with a spiral-shaped delivery groove placed between two rotating bell elements, one arranged internally and one externally, integral with one another and joined by means of a flange to the mandrel. The head is provided with four or more grooves that can be used alternately to deliver and guide the rolled product inside the laying head.

The two bells are generally made of light materials such as light alloys or composite materials which enable very high speeds of rotation to be achieved. The grooves are coated with a wear-resistant material so as to prolong their service life.

Document U.S. Pat. No. 6,098,909 describes a solution similar to that described in the previous document and suggests periodically rotating the inner bell element in relation to the outer bell element as a function of localized wear of the inner surface of the latter to expose a groove that is not worn.

However, said solutions are not satisfactory in that, if both bell elements rotate this does not allow a deceleration of the tail ends of the metal wires, so that on leaving the groove the tail ends tend to expand radially due to overspeed and collide with the end of the outer bell element producing a final coil that is not circular and has a bigger diameter than the nominal diameter. Moreover, the temperature is not ideally distributed inside the laying head with subsequent uneven dilatations that give rise to undesirable tensions in the structure, and also unbalance the rotating member.

SUMMARY OF THE INVENTION

Therefore the main purpose of this invention is to produce a laying head that is capable of operating at extremely high rolling speeds, in the region of 150 m/sec, with reduced cycle down-times and involving very low service costs.

Another purpose is to achieve better balancing of the laying head.

A further purpose is to facilitate the replacement of worn parts so that the machine can be restarted quickly.

Said purposes have been achieved with a laying head for producing coils from continuous and substantially straight products such as round bars, wire rods or other products arriving from a rolling mill or from another analogous source that, according to that set forth in claim 1, comprises a supporting structure, a rotating member that rotates about its axis, set in rotation by a motor, rotationally fixed to the supporting structure by means of bearings, in which the rotating member consists of a mandrel and a bell-shaped element cooperating axially with the mandrel and integrally placed as a prolongation of said mandrel, the bell element comprising on its outer surface a plurality of grooves that guide the rolled product and substantially have the form of a spiral, the inside of the mandrel being provided with the means for delivering the rolled product to said grooves, the laying head being characterized in that it comprises a containing and protecting element fixed to the supporting structure, enclosing said bell element and having a shape that is complementary thereto and in that said guiding grooves are open towards the outside.

Thus the invention does not make use of the tube known in the prior art to produce the coil, said tube being subject to rapid wear, deformation and subsequent dynamic unbalancing of the machine. Instead it uses a plurality of grooves or guiding channels obtained on the outer surface of a bell element associated axially with the mandrel by means of fastening means and rotating integrally therewith.

The bell element is fixed to the mandrel by means of a tie rod and central locknut, so that it can readily be removed and replaced.

The end section of the bell element is substantially cylindrical and in said section the grooves form a single worm, the pitch of which depends on the number of grooves provided on the bell-shaped element.

The grooved rotating bell element cooperates externally with another bell-shaped element, with which it mates, that is anchored to the base plate of the machine and does not rotate. The function of the fixed outer bell-shaped element is to contain the head and the tail end of the cut length of the rolled product to be coiled, that would otherwise be expelled from the laying head due to the centrifugal force. Said element thus acts as a containing and protecting element. Having a rotating bell-shaped element with grooves opening externally towards the fixed bell-shaped element has the advantage that the tail end of the rolled product is slowed down, due to the friction caused by the rolled product rubbing against the inner surface of the fixed outer bell-shaped element, along the entire length of the fixed bell-shaped element. This means than when the tail end reaches the worm at the end of the inner bell-shaped element, the rolled product does not expand and is not subject to a "whiplash" effect, so that the coils produced are perfect without any deformations.

Furthermore the presence of the fixed bell-shaped element results in a better distribution of the heat in the laying head. The entire surface of the outer bell-shaped element heats up uniformly due to irradiation thanks to the combined action of the rotation of the rotating member and the sliding of the rolled product in the groove of the inner bell-shaped element that is used from time to time. The inner bell-shaped element, instead, is subject to asymmetrical heating by conduction from the rolled product sliding through the groove that is used, but the irradiation from the outer bell-shaped element towards the inner bell-shaped element enables said thermal disparity to be reduced and compensated for. Moreover the reverberating heat from the coils unloaded onto the belt also contributes to obtaining a more homogenous temperature in the inner bell-shaped element. The thermal deformations are thus distributed uniformly and symmetrically, which further improves the dynamic balancing of the laying head.

The improvements to the laying head described above achieve several advantages:

better distribution of wear and longer machine service life, better heat distribution, improved dynamic balancing with less vibration.

According to a first embodiment of the laying head according to the invention, inside the rotary mandrel there is a rolled product delivery system in the form of a segment of a shaped tube, the open end of which faces the entrance to the groove that is used for a given period of the service life.

According to a second advantageous embodiment, said rolled product delivery system consists of two cylindrical elements placed in succession, in which the upstream element is a single-groove element and the downstream element is a multi-groove element.

BRIEF DESCRIPTION OF THE DRAWINGS

Further advantages that can be achieved with this invention will become more clear to the person skilled in the art from the following detailed description of specific but not exclusive embodiments of a laying head, with reference to the following drawings, in which.

DETAILED DESCRIPTION OF THE INVENTION

Figures 1, 8:
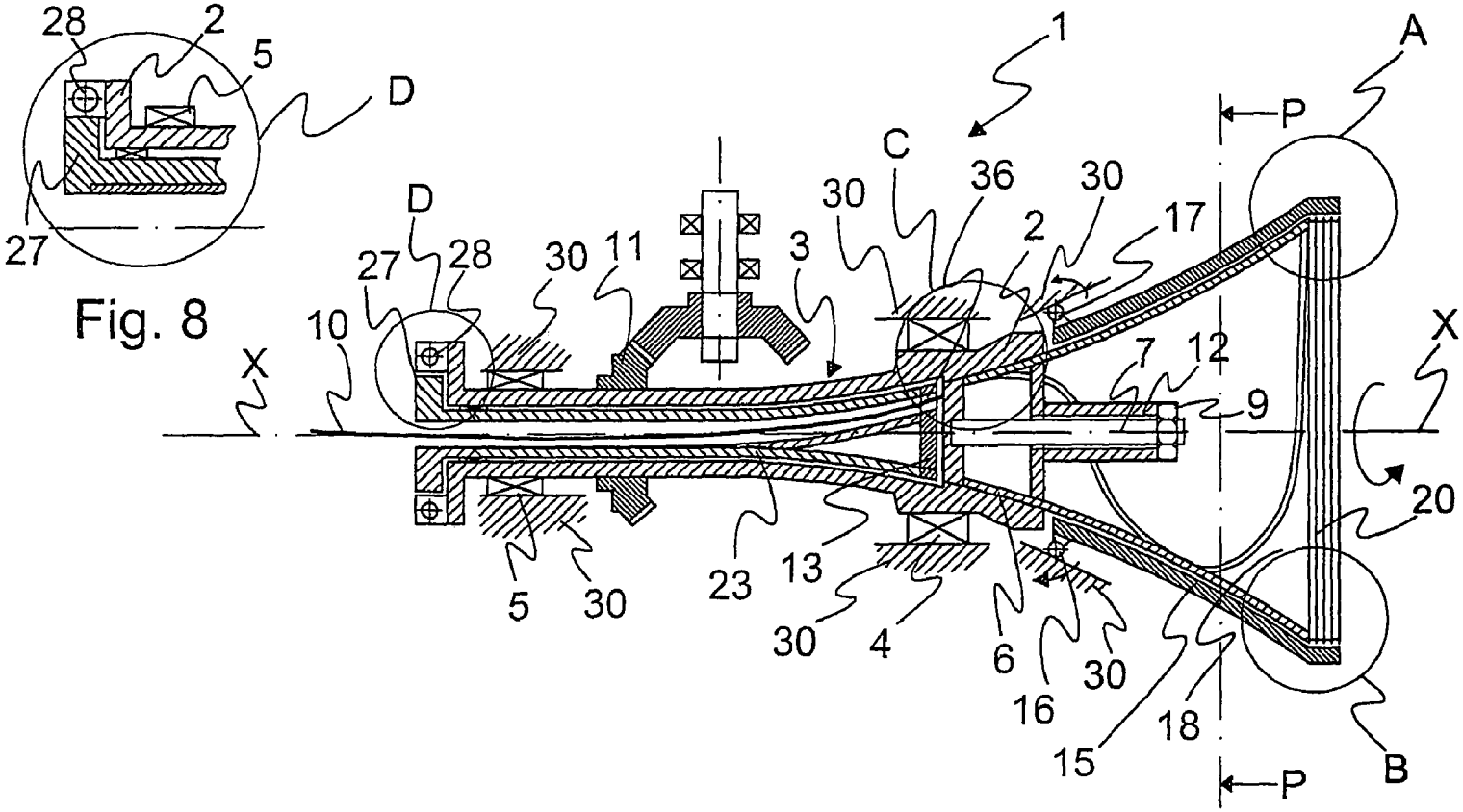
FIG. 1 shows a cross-section along an axial plane of a first embodiment of the laying head according to the invention.
FIG. 8 is the enlarged view of a detail shown inside the circled area D in FIG. 1.

With particular reference to the embodiment in FIG. 1, in which number 1 generally indicates a laying head as a whole, the drawing is a schematic illustration of a cross-section along a plane passing through the longitudinal axis of rotation X, of just some of the components thereof that are essential for the purpose of describing the invention. The head 1 comprises a rotating member 3 fixed rotationally to the support by means of two bearings 4, 5, for example mechanical roller bearings, or preferably magnetic or hydrodynamic oil film bearings, or of a mixed type, considering the high speeds that are involved.

The rotary motion is transmitted by gears, or a bevel gear pair 11, from a motor, that is not illustrated since it is of a known type, to the rotating member 3 that rotates about its axis X. The transmission mechanism may also consist of another appropriate type of device.

The rotating member 3 comprises a part that substantially consists of a mandrel 2 to which a flared bell-shaped element 6 is attached, hereafter referred to as a bell element for simplicity, by means of an appropriate fastening device that enables the two components to operate integrally and also enables the bell element 6 to be readily dismantled when it must be repaired or replaced. FIG. 1 illustrates a tie rod 7 connecting mechanism whereby a nut or locknut 9 is tightened about a spacer 12 and fastens the bell element 6 to an end section of the mandrel 2.

A substantial portion of the bell element 6 enters the mandrel 2 and in said portion the latter also acts as an outer containing element since the parts are mechanically coupled.

The remaining portion of the rotating bell element 6, cooperates externally with a fixed bell element 15 integrally anchored to the base plate of the laying head, which is not illustrated. The inner 6 and outer 15 bell elements are formed so as to mate, with limited clearance between the two bell elements, for example in the region of 1.0÷1.5 mm, which is generally sufficient to enable a relative rotation about the axis X without generating any reciprocal interference or friction, but less than the thickness of the rolled product 10.

Figure 2:
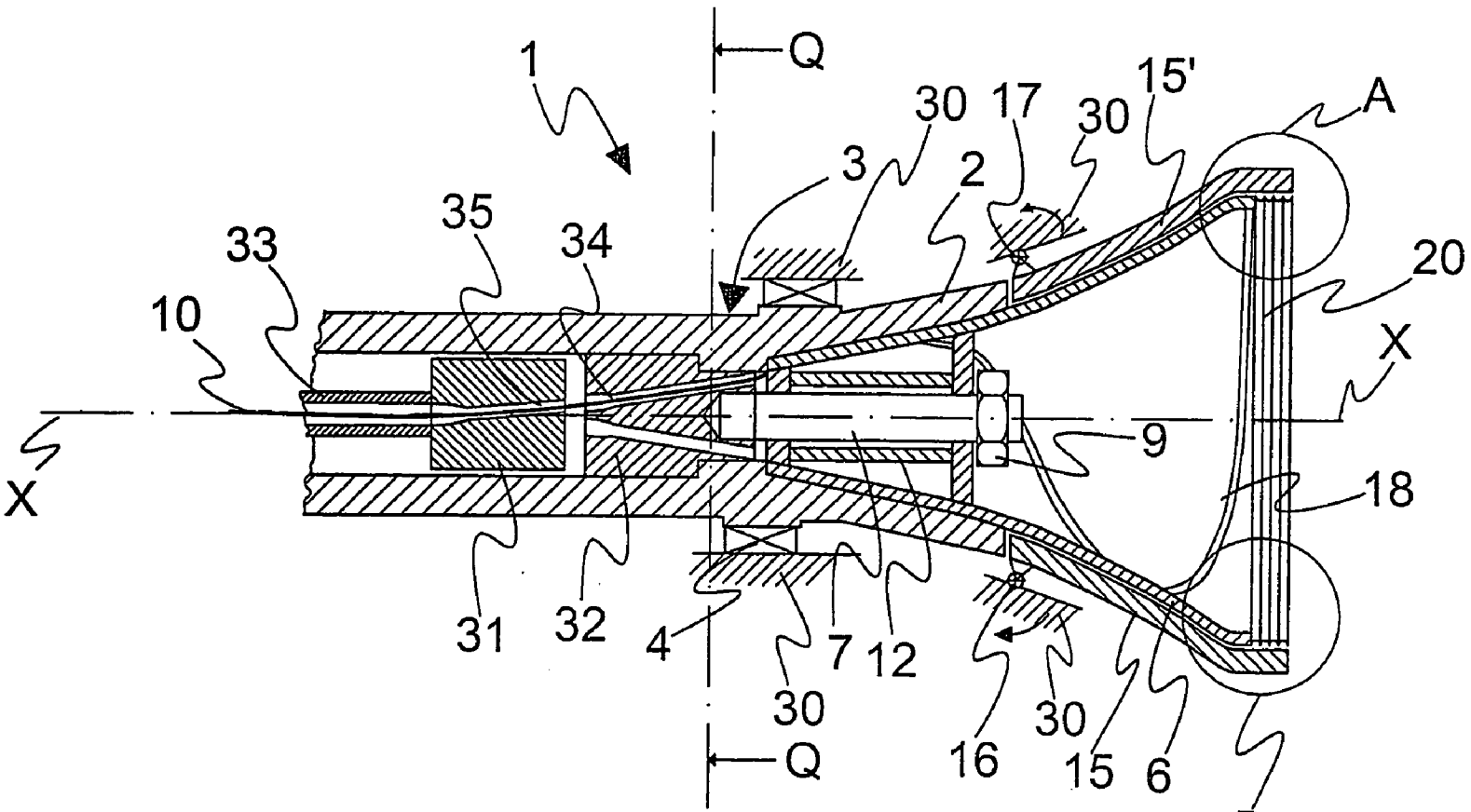
FIG. 2 shows a cross-section along an axial plane of a second embodiment of the laying head according to the invention.
Figure 5:
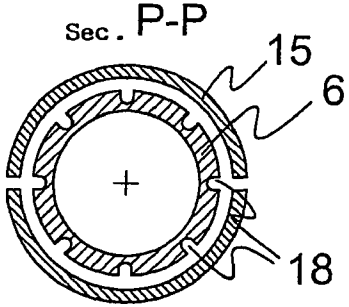
FIG. 5 shows a cross-section along the plane P-P orthogonal to the X axis of the laying head according to the invention.
Figure 6:
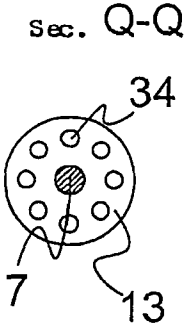
FIG. 6 shows a cross-section along the plane Q-Q orthogonal to the X axis of the laying head according to the invention.

The inner bell element 6 is provided with a plurality of grooves or channels 18 on its outer surface, only one of which is illustrated in FIGS. 1 and 2, in transparency, for the sake of clarity. In the cross-section along the plane P-P illustrated in FIG. 5, the grooves 18 are illustrated in case of an embodiment with eight grooves arranged symmetrically along the surface of the bell element 6, each of said grooves having the same depth and shape.

The grooves 18 are machined for example by means of a milling process on the bell element 6, and are substantially formed as spirals, or according to spiral trajectories obtained by means of mathematical models taking into account the material, shape and rigidity of the rolled product 10. The grooves 18 are then preferably hardened on the surface, to increase their service life, by means of chrome-plating or other coating processes. At the end of the service life of the bell element, the grooves are serviced using chemical coatings or new machining processes.

The grooves 18 are open towards the outside and have a cross-section the dimensions of which are a function of the diameter of the rolled product to be coiled, as shown in the following table referring to a typical commercial product:

| Dimensions of groove (mm) | Diameter of wire rod (mm) |
|---|---|
| 7 × 7 | 4.5 × 5.5 |
| 8.5 × 8.5 | 6.0 × 7.0 |

Having a groove 18 dimensioned to the size of the rolled product produces an accurate guide and increases the service life of the actual groove in that there are fewer collisions between the rolled product and the inside walls of the grooves during operation.

Figure 7:
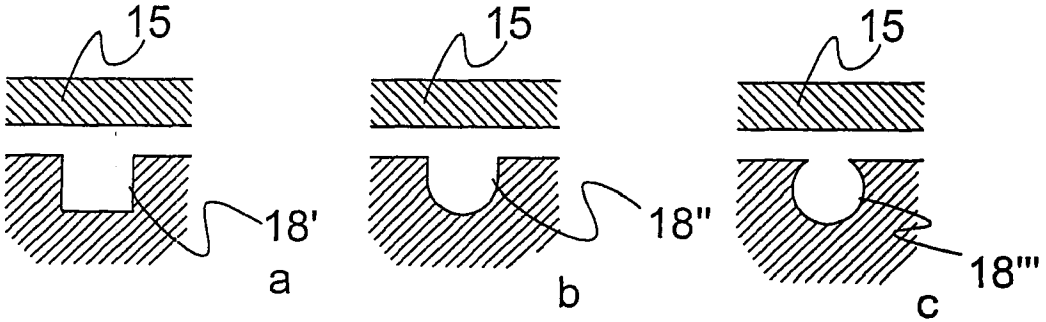
FIG. 7 shows cross-sections of details of the laying head according to the invention.
Figure 3:
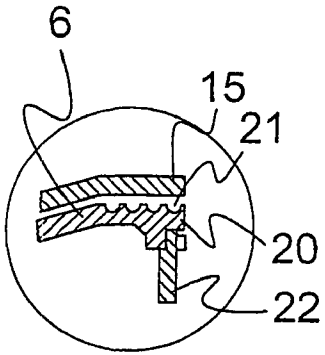
FIGS. 3 and 4 are enlarged views of the two details shown inside the circled areas A and B in FIGS. 1 and 2.
Figure 4:
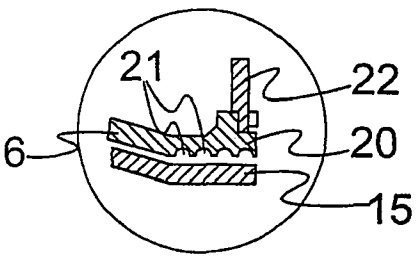

The grooves 18, 18', 18", 18'" may have cross-sections of different shapes, for example U-shaped, quadrangular or bulb-shaped, etc. as illustrated in FIG. 7. The rotating bell element of the laying heads may be provided with grooves all having a cross-section of the same shape, or all having a cross-section of a different shape and arranged along the perimeter in whatever order is considered most appropriate. The grooves may also have cross-sections that are similar in shape but of different sizes, or combinations of these solutions may also be implemented; for example opposite and symmetrical pairs of grooves may have the same dimensions, for reasons connected with the balancing of the rotating member, with the dimensions alternating between adjacent pairs, or all the grooves may be the same, or other solutions may be used. This characteristic means that the laying head according to the invention is very flexible, since each time the bell element 6 is replaced the operator can decide which type of conformation to assemble.

In any case the order in which the grooves are used must always be such that oppositely arranged grooves are used for the aforesaid reasons relating to the dynamic balancing of the rotating member when the grooves are worn.

The bell element 6 may be provided with six or, preferably, eight grooves; generally speaking an even number of grooves are provided, but an odd number of grooves may also be employed.

The inner bell 6 may, for example, be advantageously manufactured as a single block, forged and turned internally and externally, or the various structural elements may be assembled by means of welding.

The end portion 20 of the inner bell element 6 is substantially cylindrical and in said portion the grooves 21 form a single worm the pitch of which depends on the number of grooves 18 provided on the bell element 6.

In the end portion 20 of the bell element 6, the outlet section is partially closed by means of an appropriate ring-shaped flange 22, fitted to the inner surface of the bell element 6, to increase its rigidity and to act as a barrier against the reverberating heat generated by the hot coils unloaded downstream onto the belt. In any case it is shaped so as to allow access to the central nut or locknut 9 in order to dismantle the inner bell element 6.

The outer bell element 15 is preferably formed of two halves that can be opened, by rotating about hinges 16 and 17, in order to access the inner bell element 6 to check it for wear and perform maintenance operations or clear any parts that may have become clogged.

The bell element 15 is preferably cooled externally by means of a coolant applied in the form of a spray or internally by means of appropriate ducts through which coolant is forced.

From the side of the rotating member 3, through which the rolled product 10 is fed, on the left in the layout illustrated in FIG. 1, an element 23 that delivers the rolled product 10 is inserted, said delivery element having the form of an appropriately shaped tube, designed as to form a path along which the rolled product 10 is delivered towards the entrance of the grooves or channels 18 in the inner bell element. The delivery element 23 is arranged inside the mandrel 2 and is positioned by means of an axial rotation, in relation to the bell element 6, by an arc so as to place its outlet 36 in front of the entrance to the predetermined groove 18. The rotation is controlled, with the machine at a standstill, by means of a specific vernier 28 that controls a gear wheel 27 placed in the vicinity of the bearing on the side on which the rolled product 10 enters.

A second and particularly advantageous embodiment of the laying head is illustrated in FIG. 2 in which the same numbers are used to indicate the elements that are the same as those in the embodiment described above. Inside the mandrel 2 there is a first cylindrical element 32 integrally attached thereto and provided internally with a number of holes 34 equal to the number of grooves 18: thus each hole 34 is associated with a respective groove 18 on the inner bell element 6 and these rotate together adjacent to one another. This means that the wear is not only distributed among a plurality of grooves 18 on the inner bell element but also among a same plurality of holes in the cylindrical element 32. Each hole 34 has a form similar to the curved trajectory of the rolled product. Upstream of the cylindrical element 32 there is a second cylindrical element 31, which is also integrally fixed to the mandrel 2, provided with a straight hole 35 along its entire length, sloping in relation to the axis of rotation X, that selectively delivers the rolled product 10 into one of the holes 34 in the first cylindrical element 32 and from here to the grooves 18 in the inner bell element 6. The second cylindrical element 31 is angularly positioned in relation to the first cylindrical element 32 by means of appropriate adjusting means 33, either like those already described in the first embodiment or by means of other known methods. According to this second embodiment the tie rod 7 that blocks the rotating bell element 6 is advantageously screwed to the end portion of the first cylindrical element 32.

One advantageous method of using the laying head consists of making one groove work at a time until it is worn out, which generally occurs after approximately 10.000 tons of rolled product produced at a rolling speed of 150 m/sec, after which it is put out of use to allow another groove to work and this is repeated until all the grooves on the rotating bell element 6 are worn out, after which the machine is stopped and the bell element is replaced.

The laying head according to the invention is particularly suitable for high speed rolling of wire rods, with rolled product diameters ranging from 4.5 mm to 7.0 mm, i.e. for speeds of up to 150 m/sec, at which the device enjoys a long service life, producing at least 80.000 to 100.000 tons before needing to be serviced due to wear.

The end part of the head may also be formed as a cone-shaped structure or more generally have a flared shape, instead of being in the form of a bell.

From this description it is clear that the laying head according to the invention fulfils all the purposes listed in the introduction, in particular the service life of the head is increased as the grooves are used in turn and the bell element 6 of the laying head must be replaced less frequently.

The invention claimed is:

1. Laying head for forming coils from a continuous and substantially straight rolled product arriving from a rolling mill, comprising a stationary supporting structure, a rotating member that rotates about its own axis, rotationally fixed to the stationary supporting structure by means of bearings, in which the rotating member consists of a mandrel and a bell-shaped element axially cooperating with the mandrel and integrally placed as a prolongation of said mandrel, the bell-shaped element comprising on its outer surface a plurality of grooves that guide the rolled product, said grooves having a substantially spiral form, the inside of the mandrel being provided with a means for delivering the rolled product to said grooves, the laying head being characterised in that it comprises a containing and protecting element integrally anchored to the stationary supporting structure, enclosing said bell-shaped element and having a shape that is complementary thereto and in that said guiding grooves are open towards the outside.

2. Laying head according to claim 1, wherein the containing and protecting element is divided into parts that are hinged to the stationary supporting structure so as to reveal the bell-shaped element.

3. Laying head according to claim 2, wherein the means for delivering the rolled product comprise an element arranged close to the point at which the rolled product enters the rotating member, said element having the form of an appropriately shaped tube and arranged inside the rotating member, so as to form a path along which the rolled product is delivered from a position at the entrance to the rotating member centered on the axis to an entrance to the grooves, radially spaced from the axis.

4. Laying head according to claim 2, wherein the means for delivering the rolled product comprise a first cylindrical element close to the point at which the rolled product enters the rotating member, said first element being integrally fixed to the inside of the rotating member and provided internally with a plurality of holes the number of which is equal to the number of grooves.

5. Laying head according to claim 4, wherein the means for delivering the rolled product comprise a second cylindrical element, located upstream of the first cylindrical element and integrally fixed to the rotating member, provided with a straight hole sloping in relation to the axis of rotation.

6. Laying head according to claim 3 or 5, wherein there are means for angularly positioning the means for delivering the rolled product arranged close to the point at which the rolled product enters the rotating member.

7. Laying head for forming coils from a continuous and substantially straight rolled product arriving from a rolling mill, comprising a stationary supporting structure, a rotating member that rotates about its own axis, rotationally fixed to the stationary supporting structure by means of bearings, in which the rotating member consists of a mandrel and a bell-shaped element axially cooperating with the mandrel and integrally placed as a prolongation of said mandrel, the bell-shaped element comprising on its outer surface a plurality of grooves that guide the rolled product, said grooves having a substantially spiral form, the inside of the mandrel being provided with a means for delivering the rolled product to said grooves, the laying head being characterised in that it comprises a containing and protecting element integrally anchored to the stationary supporting structure, enclosing said bell-shaped element and having a shape that is complementary thereto, said bell-shaped element and said containing and protecting element being formed so as to mate with a predetermined clearance therebetween so as to enable a relative rotation about the axis and mitigating any reciprocal interference or friction, and in that said guiding grooves are open towards the outside.

* * * * *